US007912394B2

(12) United States Patent
Kondo

(10) Patent No.: US 7,912,394 B2
(45) Date of Patent: Mar. 22, 2011

(54) IMAGE PROCESSING APPARATUS CAPABLE OF CARRYING OUT IMAGE PROCESSING SUCH THAT CHARGED AMOUNT DOES NOT EXCEED UPPER LIMIT

(75) Inventor: Atsushi Kondo, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 626 days.

(21) Appl. No.: 11/270,454

(22) Filed: Nov. 10, 2005

(65) Prior Publication Data

US 2007/0031160 A1 Feb. 8, 2007

(30) Foreign Application Priority Data

Aug. 3, 2005 (JP) ..... 2005-225611

(51) Int. Cl.
*G03G 21/02* (2006.01)

(52) U.S. Cl. ..... 399/79

(58) Field of Classification Search ..... 399/79
See application file for complete search history.

(56) References Cited

U.S. PATENT DOCUMENTS

2005/0024670 A1* 2/2005 Aoki ..... 358/1.13

FOREIGN PATENT DOCUMENTS

| | | |
|---|---|---|
| JP | 9-138621 | 5/1997 |
| JP | 2000-019906 | 1/2000 |
| JP | 2001-022671 | 1/2001 |
| JP | 2001-063189 (A) | 3/2001 |
| JP | 2001-083845 A | 3/2001 |
| JP | 2003-114596 | 4/2003 |
| JP | 2003-125211 A | 4/2003 |
| JP | 2004-157190 A | 6/2004 |
| JP | 2005-047210 | 2/2005 |
| JP | 2005-062755 | 3/2005 |
| JP | 2005-174172 | 6/2005 |

OTHER PUBLICATIONS

Japanese Office Action (with English language translation) dated Aug. 7, 2007.
Decision to Grant Patent issued Mar. 12, 2008 in Japanese Patent Application No. 2005-225611 and English translation thereof.

* cited by examiner

*Primary Examiner* — David M Gray
*Assistant Examiner* — Erika Villaluna
(74) *Attorney, Agent, or Firm* — Buchanan Ingersoll & Rooney PC

(57) ABSTRACT

In a printing apparatus, a charged amount to be charged when printing is carried out under a predetermined condition is calculated in advance. If the charged amount is lower than an upper limit of the charged amount set by a user, printing is performed. Meanwhile, if the charged amount exceeds the upper limit, image processing for suppressing the charged amount or processing for changing a parameter is performed. Then, when the charged amount becomes lower than the upper limit, printing is performed.

23 Claims, 12 Drawing Sheets

FIG.6

| | THE NUMBER OF TIMES OF CHANGE IN PARAMETER (TIMES) | | | | | |
|---|---|---|---|---|---|---|
| | 1 | 2 | 3 | 4 | 5 | 6 |
| PRINT DENSITY OF COLOR IMAGE | 80(%) | 70 | 60 | 50 | 40 | 30 |
| PRINT DENSITY OF IMAGE OTHER THAN CHARACTER IMAGE | 80(%) | 70 | 60 | 50 | 40 | 30 |
| BACKGROUND IMAGE | 60(%) | 50 | 40 | 30 | 20 | 10 |
| REDUCED SIZE PRINTING OF IMAGE | 80(%) | 70 | 60 | 50 | 40 | 30 |
| PRINT MODE | 400(dpi) | 300 | 250 | 200 | 150 | 100 |

(PARAMETERS SHOWN IN COLUMN OF "6 TIMES" INDICATE LIMITS THAT CAN BE SET FOR EACH IMAGE PROCESSING)

IMAGE PROCESSING APPARATUS CAPABLE OF CARRYING OUT IMAGE PROCESSING SUCH THAT CHARGED AMOUNT DOES NOT EXCEED UPPER LIMIT

This application is based on Japanese Patent Application No. 2005-225611 filed with the Japan Patent Office on Aug. 3, 2005, the entire content of which is hereby incorporated by reference.

BACKGROUND OF THE INVENTION

1. Field of the Invention

The present invention relates to an image processing apparatus, an image processing method and an image processing program product, and more particularly to an image processing apparatus, an image processing method and an image processing program product that can carry out image processing such that a charged amount does not exceed an upper limit of the charged amount.

2. Description of the Related Art

Conventionally, it has been common that printing charge in an image processing apparatus such as a copying machine is calculated based on the number of printed pages. A user, however, has felt unfair about the fact that the charge for printing is uniform regardless of a size of a print area and the fact that, when a monochrome area occupies most part while a colored area is small, a type of printing is classified as expensive color printing.

In order to eliminate such feeling of unfairness, various charging methods have been proposed.

For example, Japanese Laid-Open Patent Publication Nos. 09-138621 and 2003-114596 disclose an image forming apparatus capable of changing a copy charge in accordance with an amount of toner consumption.

In addition, Japanese Laid-Open Patent Publication Nos. 09-138621 and 2000-019906 disclose an image forming apparatus including an economy mode for suppressing an amount of toner consumption.

Moreover, the image forming apparatus disclosed in Japanese Laid-Open Patent Publication No. 09-138621 allows the user to select a mode by presenting a charge at the time of mode selection.

According to such a charging method as changing a copy charge in accordance with an amount of toner consumption as disclosed in the publication above, however, it is difficult to expect a printing charge and the charged amount sometimes exceeds user's budget.

In addition, even when the user can know the charge in advance, there has been a disadvantage. Specifically, if the charged amount exceeds the upper limit that has been set by the user, the user has to perform a burdensome operation, such as finding optimal setting by trying various types of settings so that the charged amount does not exceed the set upper limit.

SUMMARY OF THE INVENTION

The present invention was made in view of the above-described problems. An object of the present invention is to provide an image processing apparatus, an image processing method and an image processing program product that can perform printing such that a charged amount does not exceed an upper limit of the charged amount, without a burdensome operation.

In order to achieve the object above, according to one aspect of the present invention, an image processing apparatus includes a charged amount calculation unit for calculating a first charged amount to be charged when image data is printed; a setting unit for setting an upper limit of charged amount for printing; a determination unit for determining whether the first charged amount exceeds the upper limit of charged amount; and an image processing unit for performing image processing on the image data such that a second charged amount to be charged when the processed image data is printed does not exceed the upper limit of charged amount, when the determination unit determines that the first charged amount exceeds the upper limit of charged amount.

According to another aspect of the present invention, an image processing method includes the steps of: calculating a first charged amount to be charged when image data is printed in an image processing apparatus; setting an upper limit of charged amount for printing; determining whether the first charged amount exceeds the upper limit of charged amount; and performing image processing on the image data such that a second charged amount to be charged when the processed image data is printed does not exceed the upper limit of charged amount, when it is determined in the determining step that the first charged amount exceeds the upper limit of charged amount.

According to yet another aspect of the present invention, an image processing program product causes a computer to perform image processing including the steps of: calculating a first charged amount to be charged when image data is printed in an image processing apparatus; setting an upper limit of charged amount for printing; determining whether the first charged amount exceeds the upper limit of charged amount; and performing image processing on the image data such that a second charged amount to be charged when the processed image data is printed does not exceed the upper limit of charged amount, when it is determined in the determining step that the first charged amount exceeds the upper limit of charged amount.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 illustrates a specific example of a table storing the number of times of change in a parameter and values.

DESCRIPTION OF THE PREFERRED EMBODIMENTS

Figure 1:
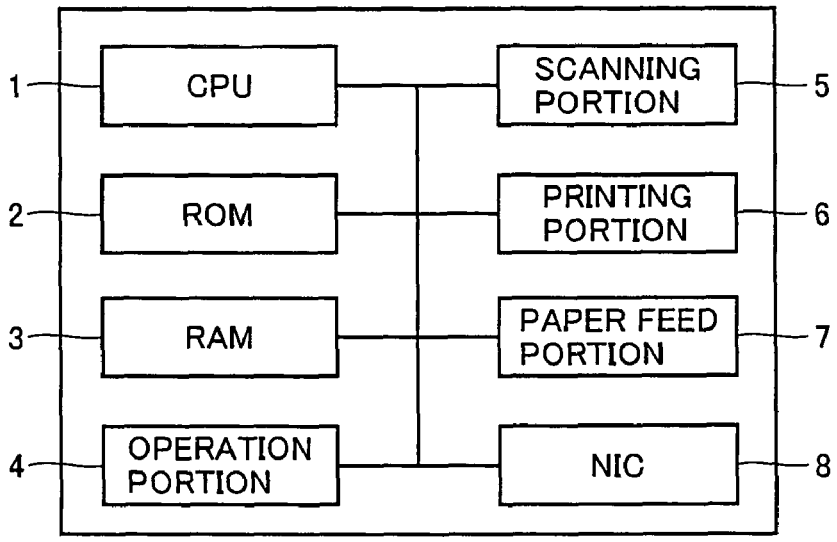
FIG. 1 is a block diagram showing a specific example of a hardware configuration of a printing apparatus.

An embodiment of the present invention will be described hereinafter with reference to the drawings. The same elements and components have the same reference characters allotted. Their label and function are also identical.

In the present embodiment, it is assumed that the image processing apparatus according to the present invention is implemented by a printing apparatus and that the printing apparatus representing a specific example of the image processing apparatus according to the present invention includes a copying machine, a facsimile machine, an MFP (Multi Function Peripherals), and the like. The image processing apparatus according to the present invention is not limited to the printing apparatus, and an image processing system incorporated in (or connected to) the printing apparatus or the like, for causing the printing apparatus or the like to perform printing, may be employed.

Referring to FIG. 1, the printing apparatus according to the present embodiment includes a CPU (Central Processing Unit) 1 controlling the entire apparatus, an ROM (Read Only Memory) 2 storing a program or the like executed in CPU 1, an RAM (Random Access memory) 3 storing image data or serving as a work area when CPU 1 executes a program, an operation portion 4 serving as an interface with the user for accepting an operation instruction, a scanning portion 5 scanning a document and reading image data from the document, a printing portion 6 printing an image on paper, a paper feed portion 7 supplying paper to printing portion 6, and an NIC (Network Interface Card) 8 serving as an expansion card inserted in a not-shown expansion slot, for connecting the printing apparatus to a network or a telephone line or for establishing short-distance radio communication. In order to store image data, a non-volatile memory such as a hard disk (HDD) may be provided.

Figure 2:
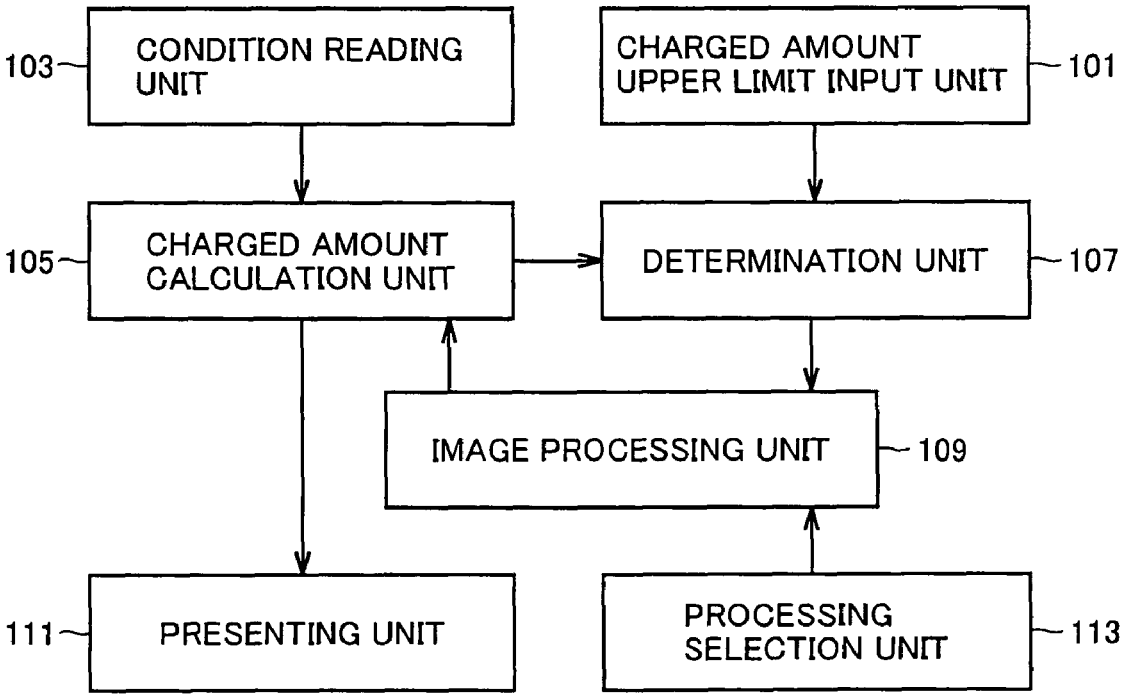
FIG. 2 is a block diagram showing a functional configuration for image processing according to the present embodiment in the printing apparatus.

Each unit shown in FIG. 2 represents a function attained in CPU 1 when CPU 1 reads and executes a program stored in ROM 2.

Referring to FIG. 2, the printing apparatus according to the present embodiment includes a charged amount upper limit input unit 101, a condition reading unit 103, a charged amount calculation unit 105 for calculating a charged amount, a determination unit 107, an image processing unit 109, a presenting unit 111, and a processing selection unit 113.

Charged amount upper limit input unit 101 connected to operation portion 4 receives an upper limit of charged amount that is input by the user and inputs the same to determination unit 107.

Condition reading unit 103 connected to operation portion 4, scanning portion 5 and the like receives scanned data or a current printing condition or the like set by the user through operation portion 4, based on which condition reading unit 103 reads a condition for calculating a charged amount. The condition for calculating a charged amount that has been read is input to charged amount calculation unit 105 or to image processing unit 109 through charged amount calculation unit 105 and the like.

Charged amount calculation unit 105 calculates a charged amount based on the condition for calculating a charged amount that has been read and input from condition reading unit 103, and inputs the calculated charged amount to determination unit 107. In addition, charged amount calculation unit 105 calculates a charged amount based on the result of processing in image processing unit 109, and inputs the calculated charged amount to presenting unit 111. The input charged amount is presented to the user by presenting unit 111.

Determination unit 107 compares the upper limit of the charged amount set by the user and input from charged amount upper limit setting unit 101 with the charged amount under the current printing condition or the like that has been calculated and input from charged amount calculation unit 105, so as to determine whether or not the charged amount exceeds the upper limit. Determination unit 107 inputs the result of determination to image processing unit 109.

Processing selection unit 113 connected to operation portion 4 receives selection of image processing that has been made through operation portion 4 by the user who had seen the presentation, and inputs the selection to image processing unit 109.

Image processing unit 109 connected to operation portion 4, scanning portion 5 and the like receives scanned data or a current printing condition or the like set by the user through operation portion 4, and performs image processing in accordance with the result of determination input from determination unit 107. Image processing unit 109 inputs the result of processing to charged amount calculation unit 105. In addition, image processing unit 109 connected to processing selection unit 113 performs image processing based on user selection that has been input through processing selection unit 113, and inputs the result of processing to charged amount calculation unit 105.

Figure 3:
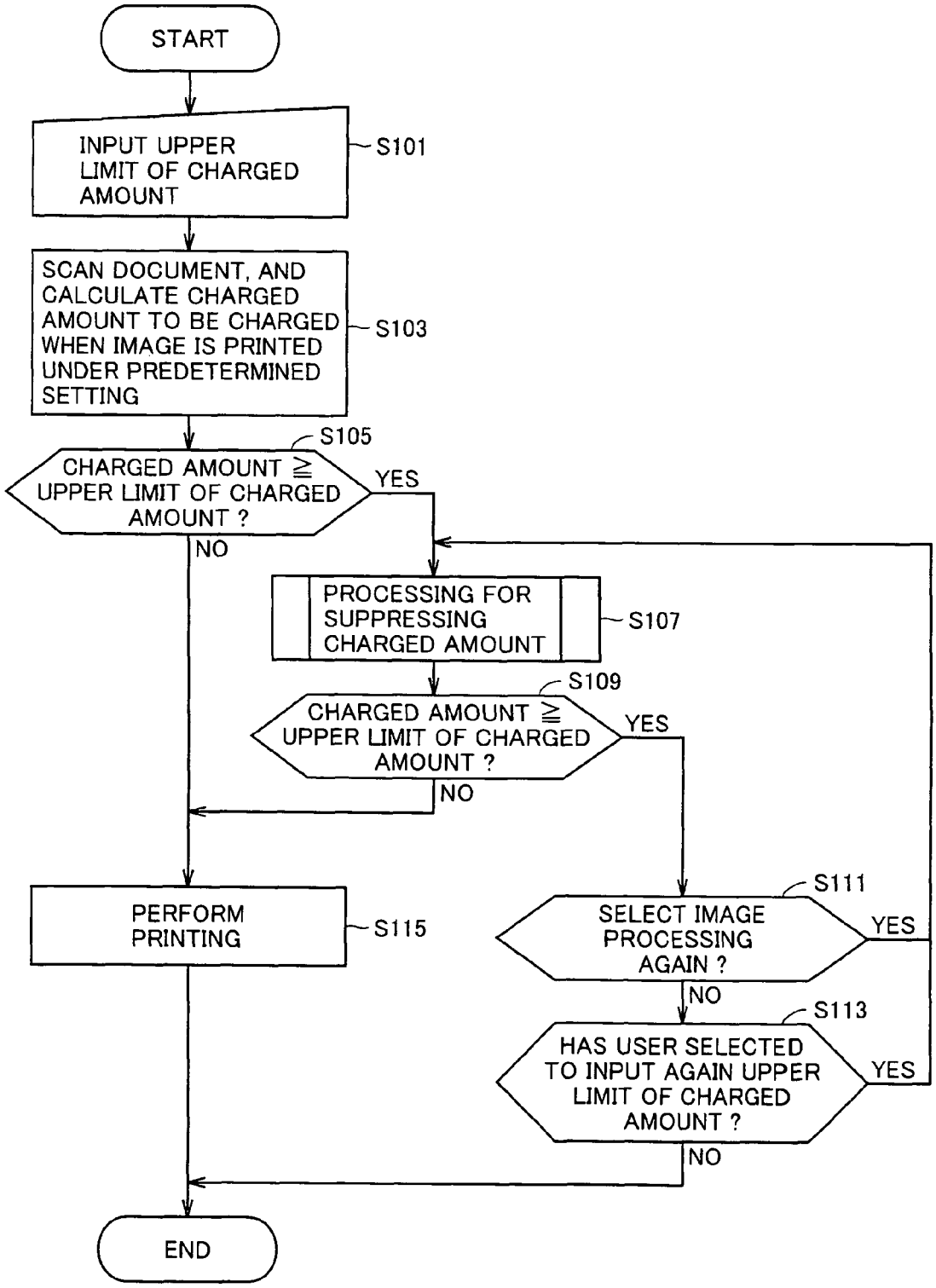
FIG. 3 is a flowchart showing a specific example of processing in the printing apparatus.

The processing shown in the flowchart in FIG. 3 is implemented in such a manner that CPU 1 reads and executes the program stored in ROM 2 to cause each unit shown in FIG. 2 to function.

Referring to FIG. 3, initially, operation portion 4 accepts an input of the upper limit of charged amount when a document is printed from the user who sets the document for printing (step S101), and scanning portion 5 scans the document. Then, charged amount calculation unit 105 calculates the charged amount when printing is performed under predetermined setting such as a condition initially set by the user or a default condition (step S103).

Specific examples of the method of calculating the charged amount at step S103 include the following two methods:

Charged amount calculating method 1: a method of calculating the charged amount by expecting an amount of toner consumption based on image data; and Charged amount calculating method 2: a method of calculating the charged amount based on an area of the image data (area to be printed).

Determination unit 107 compares the upper limit of charged amount input at step S101 with the charged amount calculated at step S103 (step S105). If the charged amount does not exceed the upper limit (NO at step S105), printing is performed under the current setting (step S115).

On the other hand, if the charged amount exceeds the upper limit of charged amount (YES at step S105), processing for suppressing the charged amount is performed in image processing unit 109 (step S107). If the charged amount no longer exceeds the upper limit of charged amount as a result of processing (NO at step S109), printing is performed under the setting at that time (step S115).

If the charged amount still exceeds the upper limit of charged amount (YES at step S109), selection again as to the setting for image processing from prescribed candidates for image processing is accepted from the user (YES at step S111), and processing for suppressing the charged amount at step S107 is performed again. If the user selects input again of the upper limit of charged amount as well (YES at step S113), processing for suppressing the charged amount at step S107 is performed again.

As will be described below, if there is no prescribed candidate for image processing at step S111 and if selection again of other image processing is not made, with the charged amount exceeding the upper limit of charged amount, such as when the charged amount exceeds the upper limit of charged amount even after the processing for suppressing the charged amount at step S107 (NO at step S111, NO at S113), printing is not performed and the process ends.

A first specific example of the processing for suppressing the charged amount is represented by image processing using a predetermined parameter (image processing parameter) in the printing apparatus.

Figure 4:
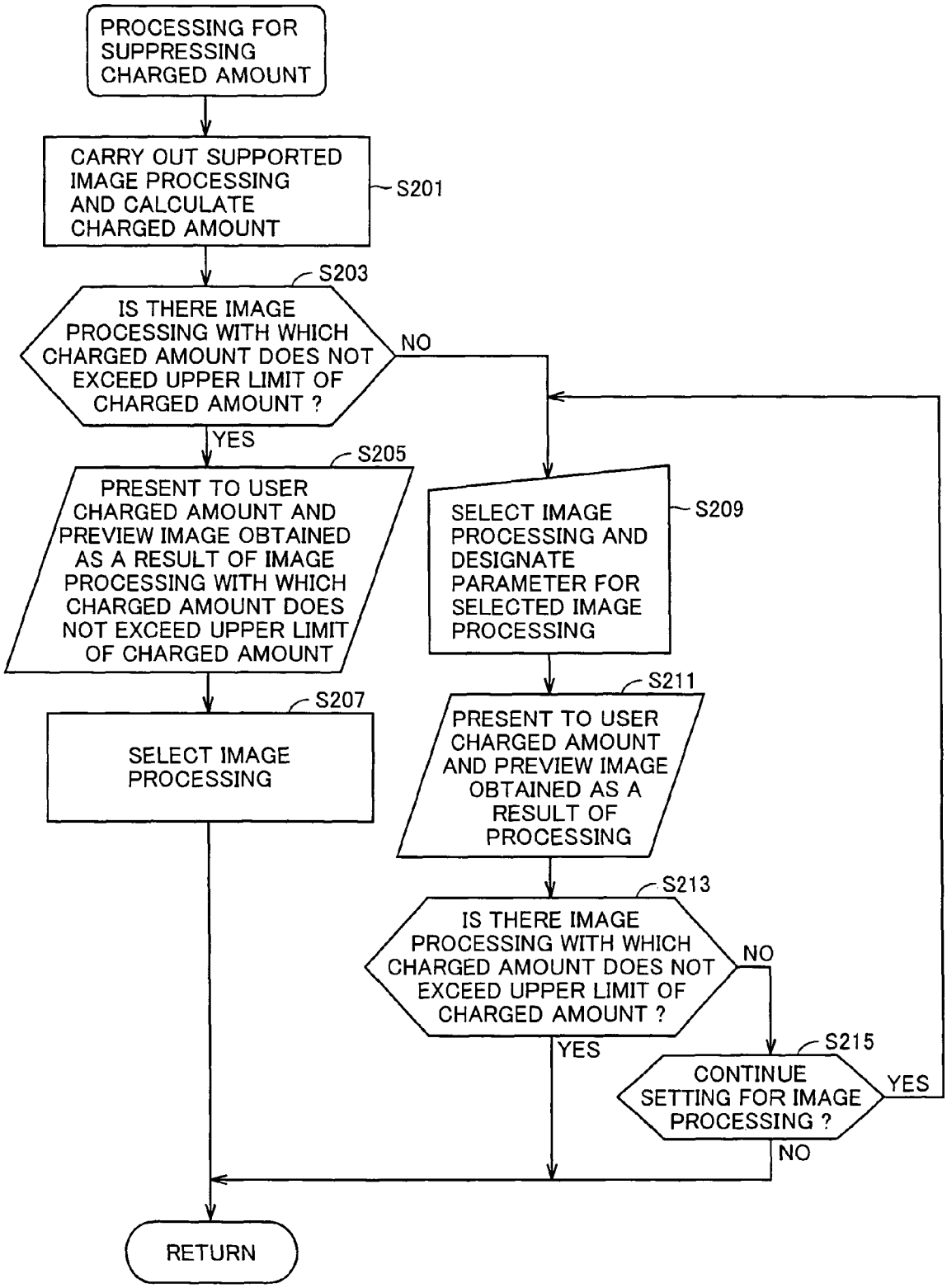
FIGS. 4 and 5 are flowcharts showing first and second specific examples of processing for suppressing a charged amount at step S107, respectively.

Referring to FIG. 4, initially, in image processing unit 109, a charged amount, that is charged when image processing supported by the printing apparatus (or image processing set at step S111 described above) is performed on target image data using a predetermined parameter, is calculated (step S201). Image processing performed at step S201 includes modification of density, compression of image and the like, each of which will be described later. At step S201, one or more types of processing is performed in accordance with the supported image processing.

If there is image processing with which the charged amount does not exceed the upper limit of charged amount among image processing performed at step S201 (YES at step S203), the charged amount in that processing is presented by presenting unit 111 and the result of processing is displayed for preview (step S205). When the user who has referred to the presentation selects desired image processing and image processing for printing is selected (step S207), the process returns to a main routine shown in FIG. 3.

If there is no image processing with which the charged amount does not exceed the upper limit of charged amount among image processing performed at step S201 (NO at step S203), selection of image processing and designation of a parameter for that image processing are accepted from the user (step S209). Then, charged amount calculation unit 105 calculates the charged amount when that image processing is performed under that condition, presenting unit 111 presents the charged amount in that processing, and the result of image processing is displayed for preview (step S211).

If there is image processing with which the charged amount does not exceed the upper limit of charged amount among image processing selected at step S209 and/or the designated parameter for that image processing (YES at step S213), the image processing, or the image processing selected at step S209 and/or the designated parameter for that image processing is returned to the main routine shown in FIG. 3.

Here, as it is determined at step S109 described above that the charged amount exceeds the upper limit of charged amount in that state (YES at step S109), these types of image processing are presented as candidates, and the user can select again desired image processing, by referring to presentation.

On the other hand, if the charged amount exceeds the upper limit of charged amount with regard to the image processing selected at step S209 and/or all the designated parameters for that image processing (NO at step S213), setting at step S209 is accepted again, in accordance with a user instruction as to whether to make image processing setting again (step S215). Alternatively, even if processing for suppressing the charged amount is performed, the process returns to the main routine shown in FIG. 3, assuming that the charged amount exceeds the upper limit of charged amount.

One specific example of the method of calculating the charged amount after image processing at steps S201, S211 described above is represented by a method including the following STEP1 to STEP4.

STEP1: expect a charged amount before image processing, for each area to be subjected to image processing STEP2: expect a charged amount after image processing, for each area to be subjected to image processing STEP3: calculate a difference in the charged amount between before and after image processing STEP4: subtract the difference from the already-calculated charged amount to be charged when image processing is not performed If charged amount calculating method 1, that is, the method of calculating the charged amount by expecting an amount of toner consumption based on image data, is employed as the method of calculating the charged amount in the printing apparatus, one specific example of the method of calculating the charged amount after image processing is represented by a method including the following STEP1 to STEP4.

STEP1: expect an amount of toner consumption before and after image processing for each area to be subjected to image processing and calculate a reduced amount of toner consumption STEP2: sum the amounts of toner consumption that have been calculated at STEP1 and calculate a reduced amount of toner consumption for the entire document STEP3: calculate an amount of money reduced as a result of image processing, based on the amount of toner that has been calculated at STEP 2 and on a unit price STEP4: subtract the amount of money that has been calculated at STEP 3 from the charged amount before image processing If charged amount calculating method 2, that is, the method of calculating the charged amount in accordance with an area of image data (area to be printed), is employed as the method of calculating the charged amount in the printing apparatus, one specific example of the method of calculating the charged amount after image processing is represented by a method including the following STEP1 to STEP4.

STEP1: calculate a difference in an area between before and after image processing, for each area to be subjected to image processing STEP2: sum the areas that have been calculated at STEP1 and calculate a reduced area in the entire document STEP3: calculate an amount of money reduced as a result of image processing, based on the area that has been calculated at STEP 2 and on a unit price STEP4: subtract the amount of money that has been calculated at STEP 3 from the charged amount before image processing In the second specific example of the processing for suppressing the charged amount, image processing and the parameter are automatically changed in the printing apparatus.

Figure 5:
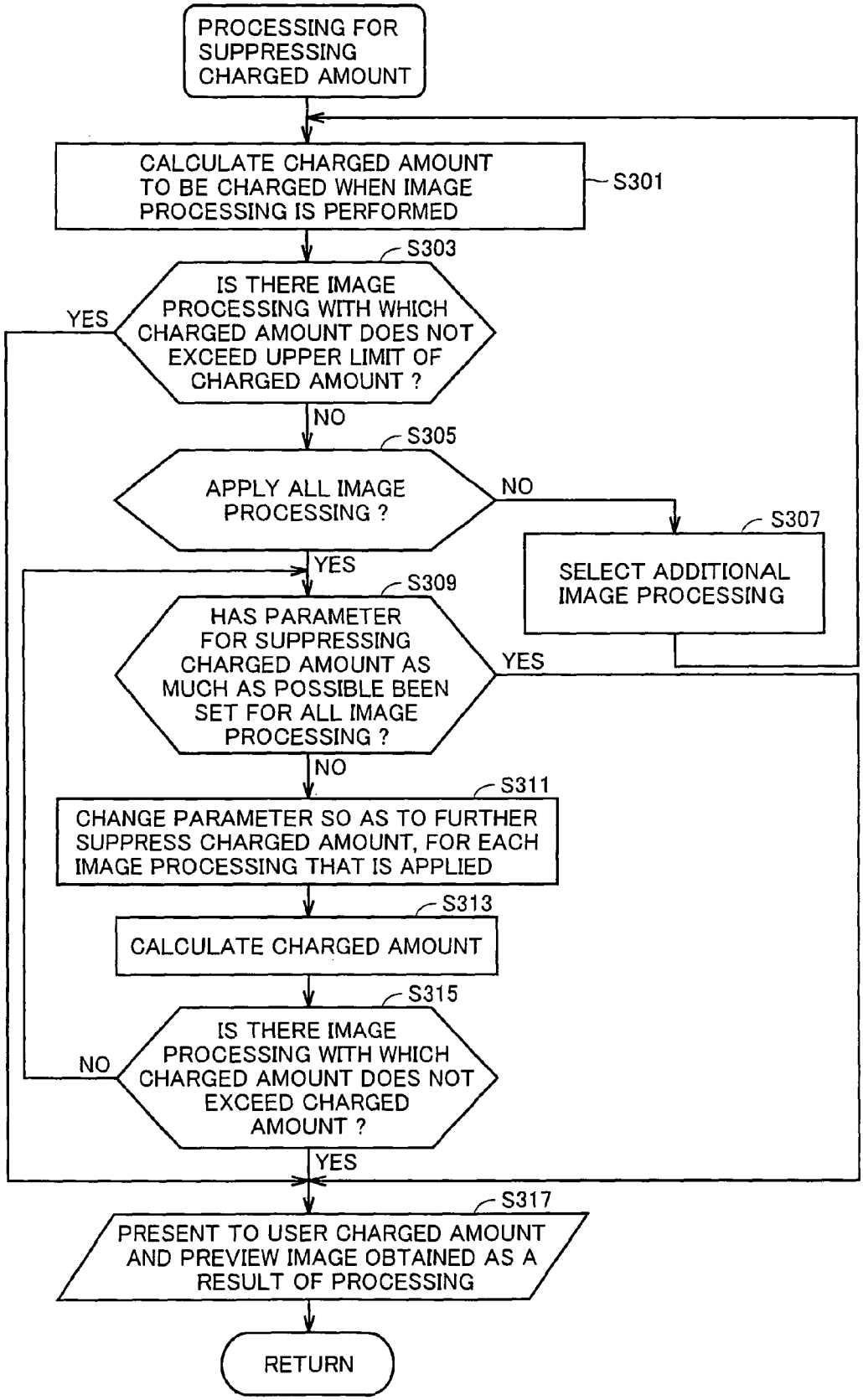

Referring to FIG. 5, initially, charged amount calculation unit 105 calculates a charged amount to be charged when predetermined image processing (or image processing set at step S111 described above) is performed using a predetermined parameter (step S301). If there is image processing with which the charged amount does not exceed the upper limit of charged amount (YES at step S303), the charged amount in that image processing is presented by presenting unit 111 and the result of processing is displayed for preview (step S317), as in the first specific example. Then, the image processing returns to the main routine shown in FIG. 3.

On the other hand, if there is no image processing with which the charged amount does not exceed the upper limit of charged amount among image processing performed at step S301 and there is image processing that has not yet been applied among image processing supported by the printing apparatus (NO at step S303 and NO at step S305), the image processing that has not yet been applied is selected in addition to the image processing at step S301 (or instead of the image processing at step S301) (step S307), and the process from step S301 is repeated.

If there is no image processing with which the charged amount does not exceed the upper limit of charged amount even after all types of image processing supported by the printing apparatus are applied (NO at step S303 and YES at step S305), determination unit 107 determines whether an optimal parameter capable of suppressing the charge as much as possible has been set for each of all applied types of image processing. If image processing in which an optimal parameter has not been set is included (NO at step S309), in image processing unit 109, the currently used parameter is changed by a prescribed amount and changed to such an optimal parameter as further suppressing the charge for the image processing (step S311). Charged amount calculation unit 105 calculates the charged amount in that case (step S313).

The processing method at step S311 is represented by a method of repeating the processing the prescribed number of times, with the parameter being changed by a prescribed value. Here, as shown in FIG. 6, preferably, the number of times of change and a numeric value are determined in advance for each parameter and stored.

The processing at steps S309 to S315 described above is repeated until the optimal parameter capable of suppressing the charge as much as possible is set for all applied types of image processing or until image processing with which the charged amount does not exceed the upper limit of charged amount is included. If the optimal parameter capable of suppressing the charge as much as possible is set for all applied types of image processing (YES at step S309) or if there is image processing with which the charged amount does not exceed the upper limit of charged amount (YES at step S315), presenting unit 111 presents the charged amount for that image processing and the result of processing is displayed for preview (step S317).

If there is image processing with which the charged amount does not exceed the upper limit of charged amount among all types of image processing that have been applied (YES at step S315), the image processing and/or the parameter for that image processing is/are returned to the main routine shown in FIG. 3. If there is no image processing with which the charged amount does not exceed the upper limit of charged amount even after the optimal parameter capable of suppressing the charge as much as possible is set for all applied types of image processing (NO at step S315 and YES at step S309), the process returns to the main routine shown in FIG. 3, assuming that the charged amount exceeds the upper limit of charged amount even after the processing for suppressing the charged amount.

Specific examples for image processing effective for suppressing the charged amount that is performed at step S201 or at step S301 above and supported by the printing apparatus according to the present embodiment include the following.

(Image Processing Example 1) Image Processing for Changing Print Density

According to this image processing, an amount of toner consumed when a target image is printed is reduced. When charged amount calculating method 1 (the calculating method based on the amount of toner consumption) is adopted in charged amount calculation unit 105, this image processing is effective.

Figure 7A:
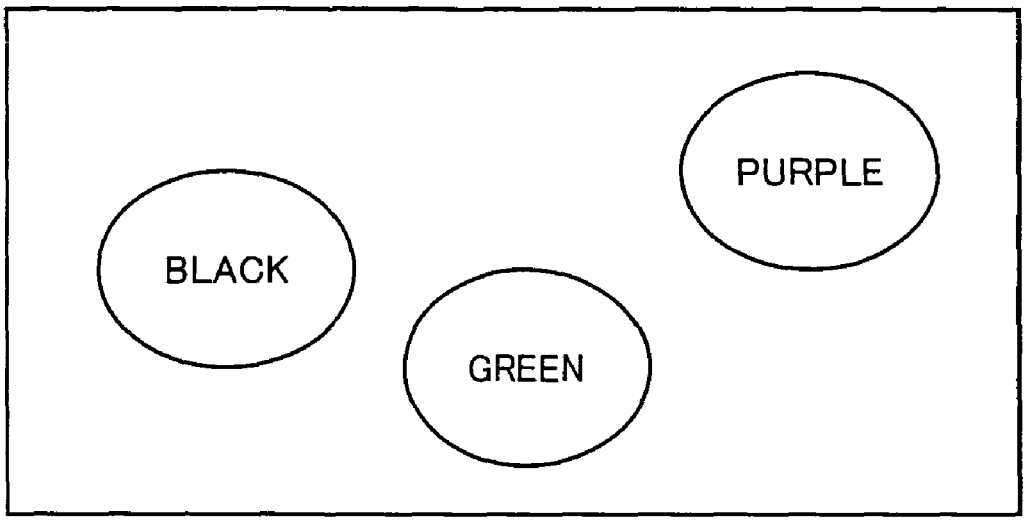
FIGS. 7A to 9B illustrate specific examples of image processing example 1.
Figure 7B:
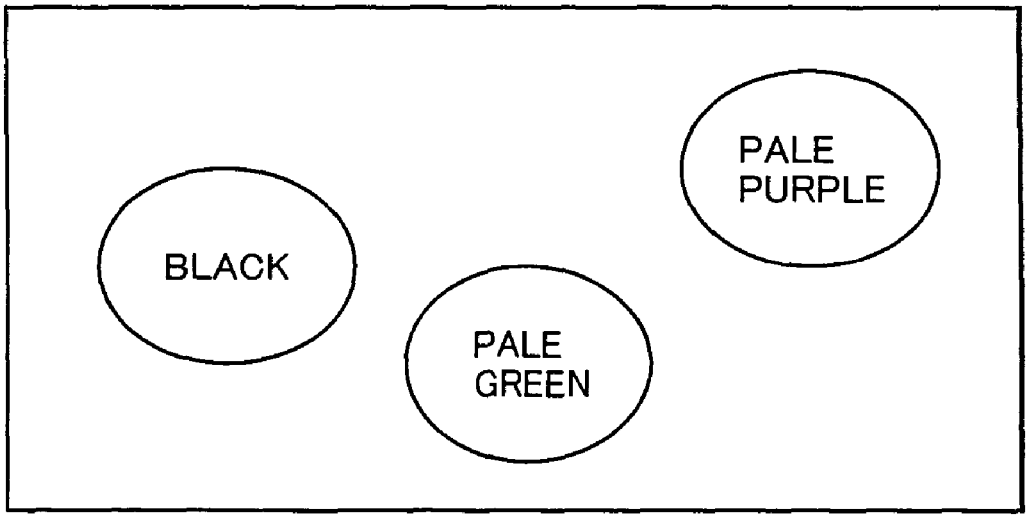

In particular, when condition reading unit 103 reads as a printing condition that the target image is a color image as shown in FIG. 7A, preferably, print density is lowered in order to form a print image as shown in FIG. 7B, with priority being placed on a color area ("green" and "purple" areas in FIG. 7A) relative to a monochrome area ("black" area in FIG. 7A).

Figure 8A:
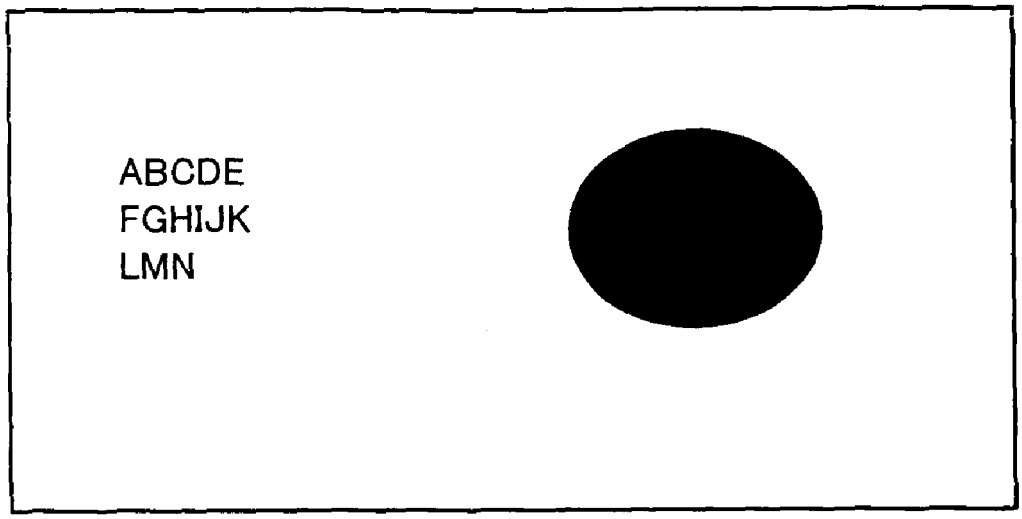
Figure 8B:
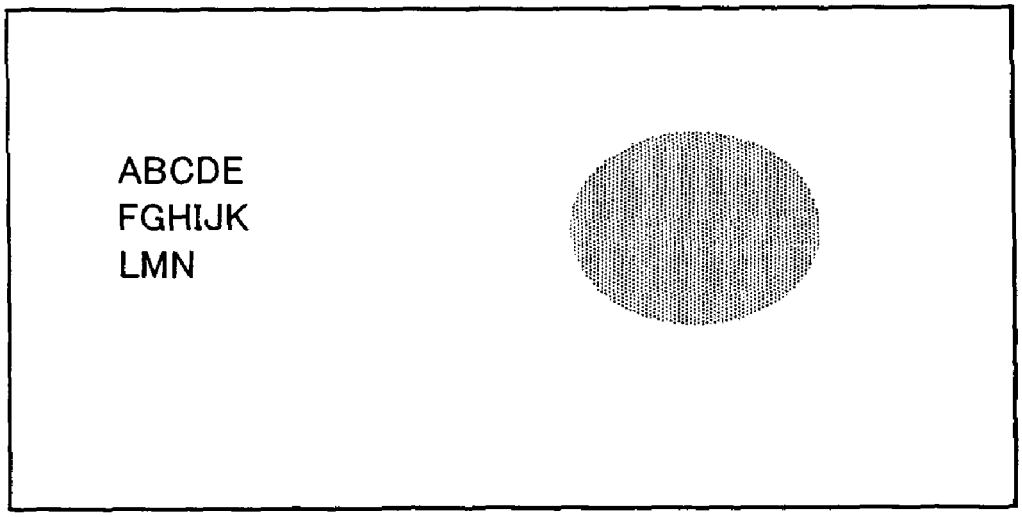

Alternatively, when condition reading unit 103 reads as a printing condition that the target image includes a character image and an image not including characters as shown in FIG. 8A, preferably, print density is lowered in order to form a print image as shown in FIG. 8B, with priority being placed on the image not including characters relative to the character image.

Figure 9A:
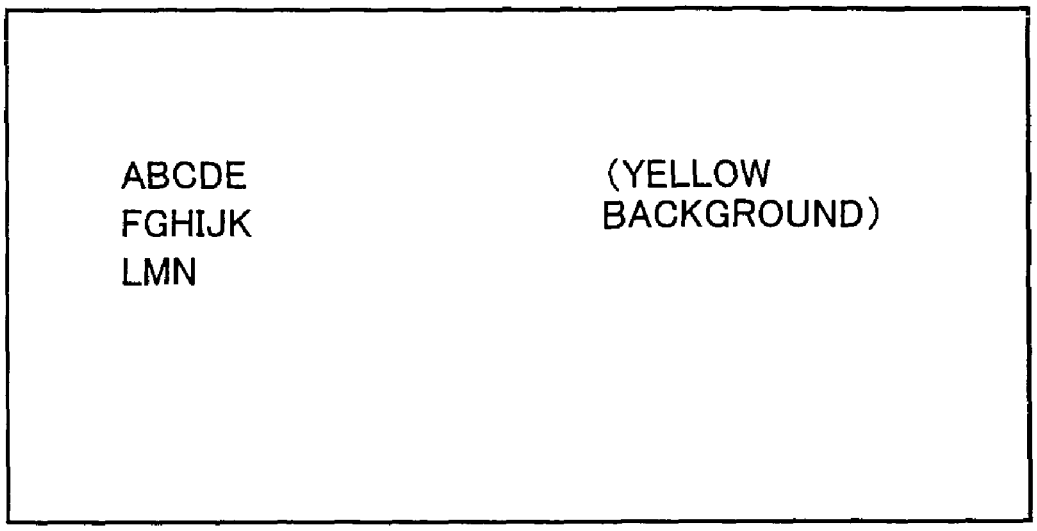
Figure 9B:
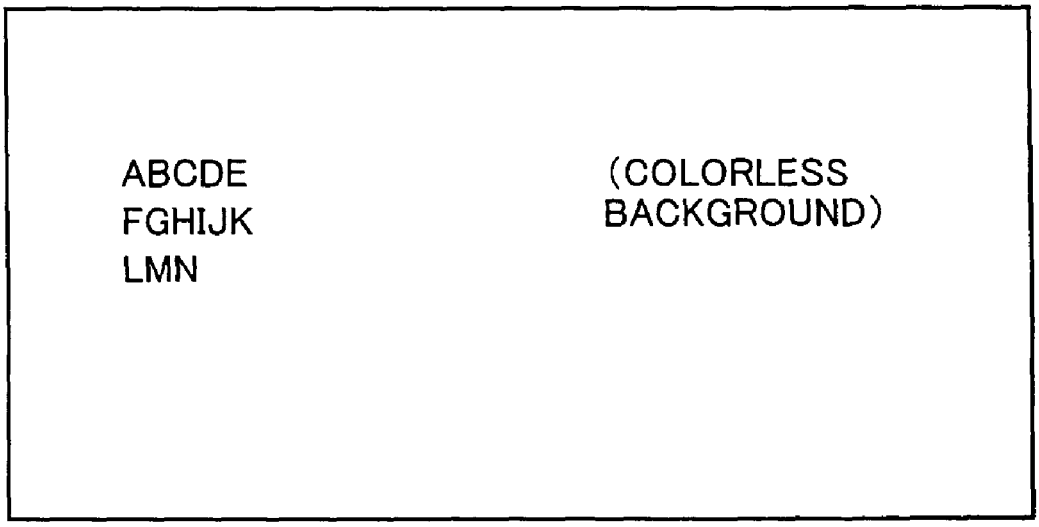

Alternatively, when condition reading unit 103 reads as a printing condition that the target image includes a background image (including a case of only color) as shown in FIG. 9A, preferably, print density is lowered in order to form a print image as shown in FIG. 9B, with priority being placed on the background image ("yellow background" in FIG. 9A) relative to other image ("character image" in FIG. 9A).

If condition reading unit 103 reads as a printing condition that the target image includes as a background image a ground pattern which is an image aiming to prevent duplication, preferably, image processing unit 109 does not consider the ground pattern as a processing target, and the density of the ground pattern is not lowered.

(Image Processing Example 2) Image Processing for Reducing Image Size

According to this image processing, a size of an image area included in a target image is reduced. When charged amount calculating method 2 (the calculating method based on the size of the print area) is adopted in charged amount calculation unit 105, this image processing is effective.

Figure 10A:
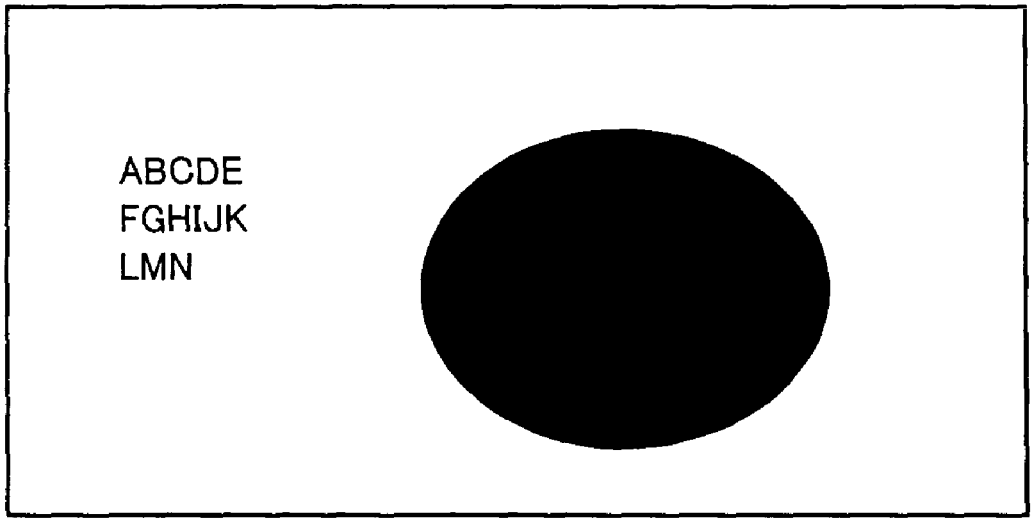
FIGS. 10A to 11B illustrate specific examples of image processing examples 2 and 3.
Figure 10B:
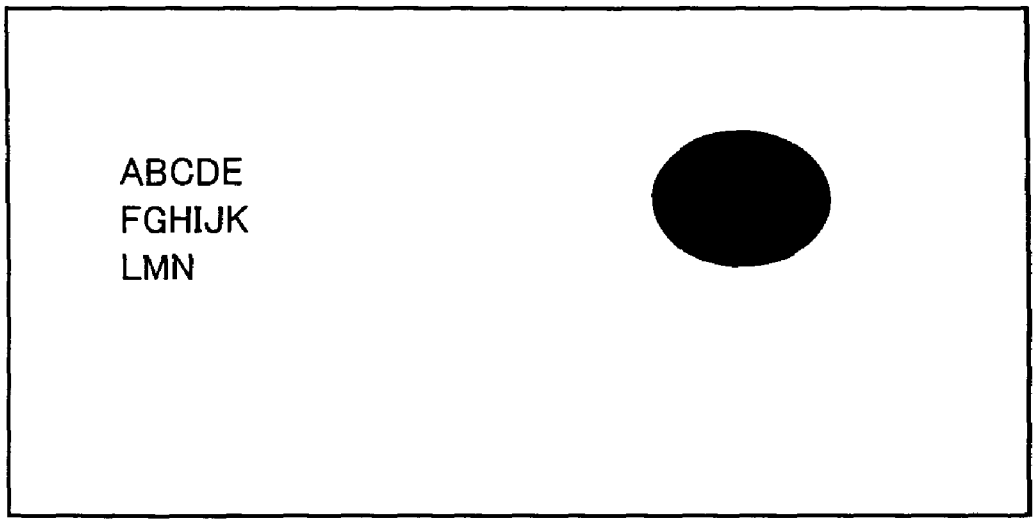

In particular, when condition reading unit 103 reads as a printing condition that the target image includes a character image and an image not including characters as shown in FIG. 10A, preferably, the image size is reduced in order to form a print image as shown in FIG. 10B, with priority being placed on the image not including characters relative to the character image.

Examples of a method of reducing the image size include:

(Size reduction method example 1) a method of reducing the size of all images to be subjected to size reduction that are included in a target image, at a uniform reduction scale; and (Size reduction method example 2) a method of reducing the size of an image having a larger area, among images to be subjected to size reduction that are included in a target image, at a larger reduction scale.

(Image Processing Example 3) Image Processing for Lowering Resolution

The print image generated by the printing apparatus is constituted of extremely small-sized dots. Density of the dots is expressed in terms of print resolution (unit: dpi (Dot Per Inch)). If density of the dots to be printed is lowered (thinning out of the dots), an amount of toner consumption can be reduced. Therefore, this image processing is effective when charged amount calculating method 1 (the calculating method based on the amount of toner consumption) is adopted in charged amount calculation unit 105. The processing for lowering resolution (density of dots) in printing is called a "draft mode" or an "economy mode", and such processing is adopted in a general printing apparatus in many cases.

Figure 11A:
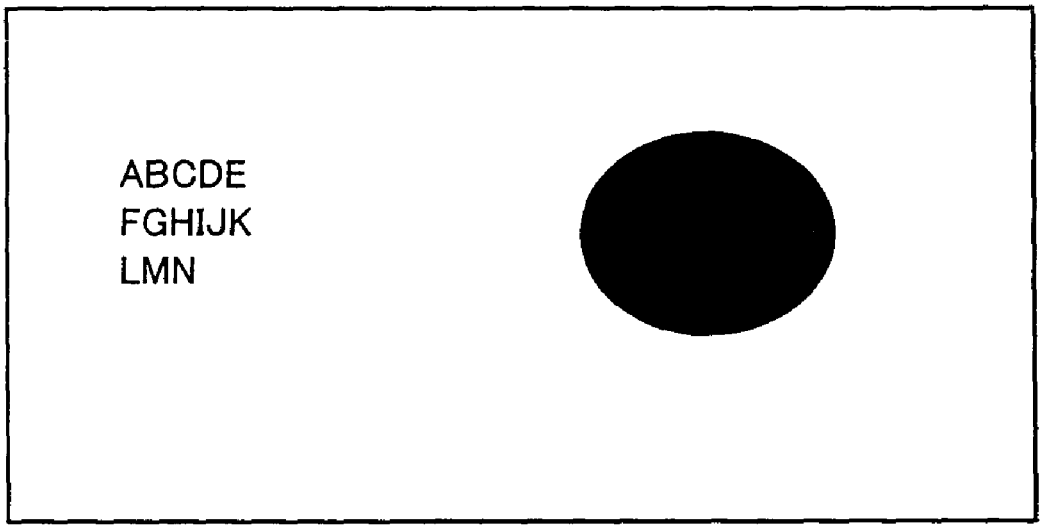
Figure 11B:
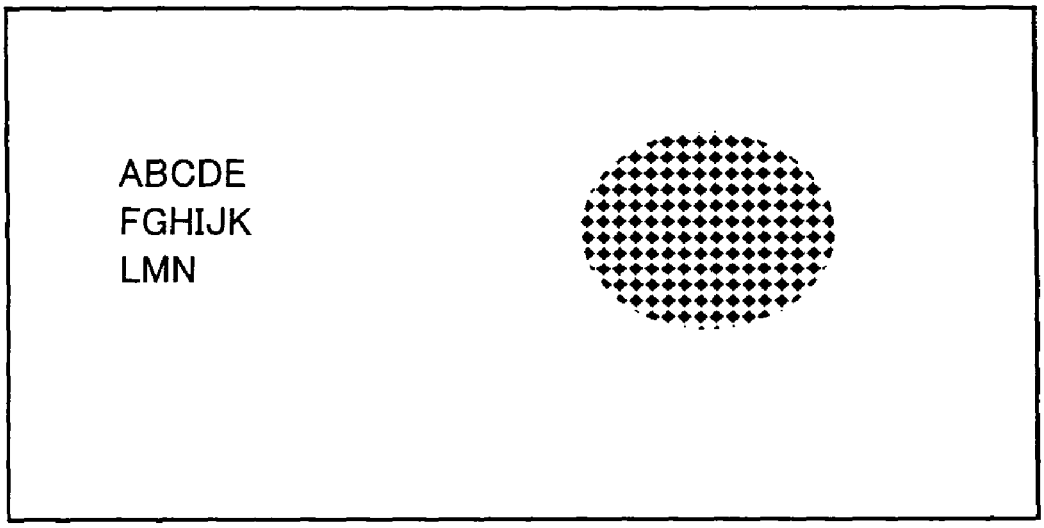

In particular, when condition reading unit 103 reads as a printing condition that the target image includes a character image and an image not including characters as shown in FIG. 11A, preferably, resolution is lowered in order to form a print image as shown in FIG. 11B, with priority being placed on the image not including characters relative to the character image.

As described above, if image processing is performed such that the charged amount does not exceed the upper limit of charged amount, image quality is lowered to some extent as compared with a document image. Therefore, a "priority-on-charge" mode referring to printing in which the image processing is performed such that the charged amount does not exceed the upper limit of charged amount, and a "priority-on-image quality" mode referring to printing for forming an image close to the document image regardless of the charge (normal printing) may be provided, and setting of either mode may be accepted before step S101 described above.

In the embodiment above, the input of the upper limit of charged amount for printing in which the entire document is subjected to image processing is accepted at step S101, and in the processing thereafter, image processing is performed on the entire document such that the charged amount does not exceed the upper limit. Alternatively, if the document consists of a plurality of pages (or a plurality of prescribed blocks), not only the input of the upper limit of charged amount for that printing but also the setting for each page (or each block) as to whether each page (or each block) should be subjected to image processing, that is, setting for each page (or each block) as to whether priority is placed on charge or on image quality for each page (or each block) may be accepted at step S101 above, and in the processing thereafter, solely the target page (or block) may be subjected to image processing such that the total charged amount does not exceed the upper limit.

Figure 12:
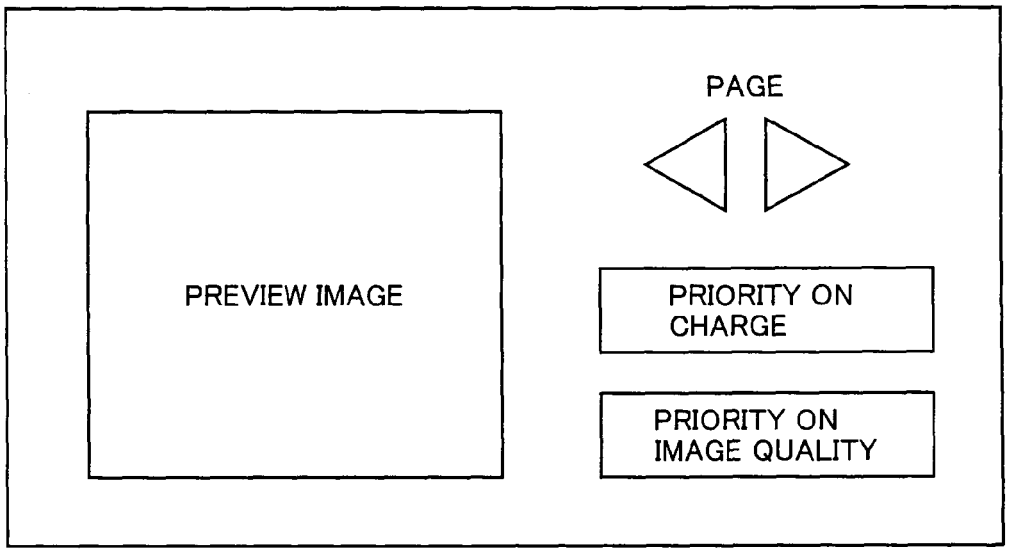
FIG. 12 illustrates a specific example of a screen for modifying the setting.

In the latter case, at step S101, preferably, a screen for modifying the setting as shown in FIG. 12 is presented to the user, so as to accept the setting for each page as to whether each page is subjected to image processing, that is, setting for each page as to whether priority is placed on charge or on image quality for each page. As shown in FIG. 12, the screen for modifying the setting includes a button for designating a page (a button for moving the page forward or backward, or the like) and a button for designating whether priority is to be placed on charge or on image quality (by highlighting or the like) (a button for switching between priority-on-charge and priority-on-image quality), and preferably further includes a display portion for displaying a preview image of the designated page (or all pages). The setting for each page as to whether each page should be subjected to image processing, that has been input as described above, is associated with the scanned data of that page, and this setting is read by condition reading unit 103 as the print condition.

Figure 13:
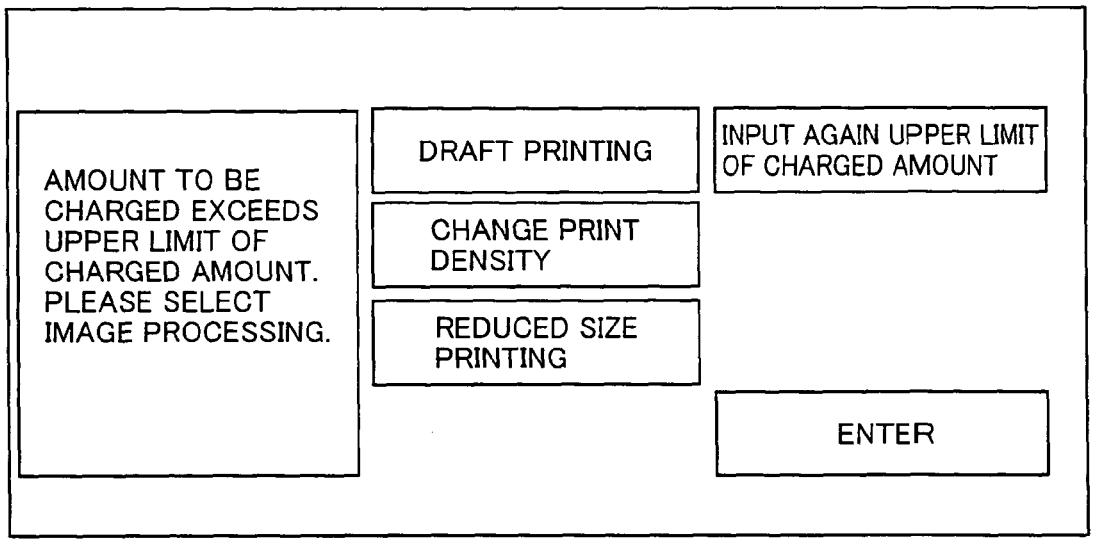
FIG. 13 illustrates a specific example of a screen for selection.

In addition, at step S107 described above, the processing for suppressing the charged amount has been performed by applying the supported image processing as appropriate in the printing apparatus. Alternatively, a selection screen as shown in FIG. 13 may be presented in advance to the user in order to accept designation of desired image processing from the user, and the processing for suppressing the charged amount may be performed in the designated image processing. Alternatively, if the charged amount still exceeds the upper limit even after the processing at step S107, the selection screen as shown in FIG. 13 may be presented to the user at step S111 to show prescribed candidates for image processing, so that designation for desired image processing may be accepted, so as to perform again the processing for suppressing the charged amount.

As shown in FIG. 13, the selection screen includes a display portion for displaying a message urging the user to select desired image processing, a button for selecting image processing, and a button for determining image processing, and preferably further includes a button for displaying a screen for setting the upper limit of charged amount for input again of the upper limit of charged amount at step S113.

Figure 14:
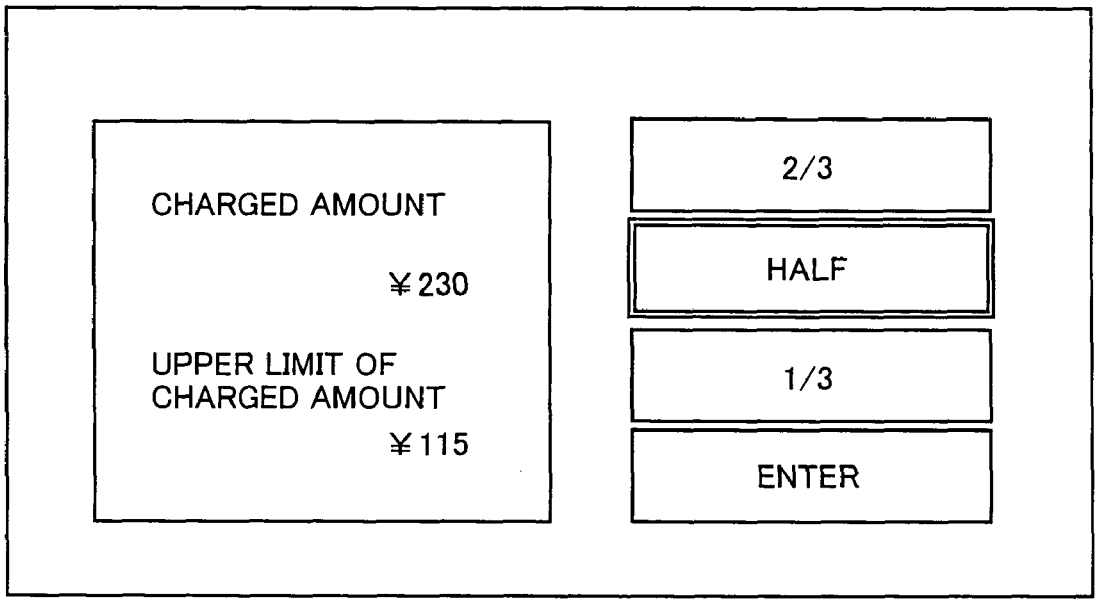
FIG. 14 illustrates a specific example of a screen for setting the upper limit of charged amount.

The order of processing in the printing apparatus according to the present embodiment is not limited to that shown in FIG. 3. For example, calculation of the charged amount at step S103 and presentation of the charged amount to the user may precede the input of the upper limit of charged amount at step S101. In addition, the screen for setting the upper limit of charged amount as shown in FIG. 14 may be presented to the user, in order to allow the user to input the upper limit of charged amount based on the presented charged amount. As shown in FIG. 14, the screen for setting the upper limit of charged amount includes a display portion for displaying the charged amount when printing is performed under the predetermined setting that is calculated at step S103, a button for designating the upper limit of charged amount based on the charged amount (by highlighting or the like), a display portion for displaying the upper limit of charged amount that has been calculated, and a button for determining the upper limit of charged amount. More specifically, as shown in FIG. 14, a button designating a ratio to the charged amount (⅔, half price (½), ⅓) is included as the button for designating the upper limit of charged amount based on the charged amount. When any of these of button is pressed, the upper limit of charged amount to be set is calculated and displayed.

The image processing described above is performed in the printing apparatus according to the present embodiment, so that the user can carry out, with a simplified operation, such printing that the charged amount does not exceed the designated upper limit.

The processing method performed in printing as described above may be provided as a program. Such a program can be recorded on a computer-readable recording medium such as a flexible disk, a CD-ROM (Compact Disk-Read Only Memory), an ROM, an RAM, and a memory card adapted to a computer, and can be provided as a program product. Alternatively, the program may be recorded and provided in a recording medium such as a hard disk contained in the computer. Further, the program may be provided by downloading through the network.

The provided program product is installed in a program storage unit such as a hard disk for execution. It is noted that the program product includes the program itself and the recording medium recording the program.

The image processing apparatus according to the present invention accepts the setting of the upper limit of charged amount, and performs image processing such that the charged amount for printing does not exceed the upper limit. Therefore, the user can carry out, with a simplified operation, such printing that the upper limit of charged amount is not exceeded.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image processing apparatus comprising:

a charged amount calculation unit for calculating a first charged amount to be charged when a printed image is printed from the image data;

a setting unit for setting an upper limit of a charged amount for printing of said image data;

a determination unit for determining whether said first charged amount exceeds said upper limit of said charged amount; and an image processing unit configured to analyze and select a target image, said target image corresponding to a portion of the printed image that is less than an entire region of the printed image, said image processing unit further configured to perform image processing on said selected target image with a priority placed on the target image to create a revised printed image such that the target image is processed to a greater extent than a remainder of the printed image and such that a second charged amount to be charged when said revised printed image is printed no longer exceeds said upper limit of said charged amount, when said determination unit determines that said first charged amount exceeds said upper limit of said charged amount.

2. The image processing apparatus according to claim 1, wherein said image processing unit can perform a plurality of types of image processing on said target image and accepts selection of specific image processing from said plurality of types of image processing.

3. The image processing apparatus according to claim 1, wherein there are a plurality of parameters available for said image processing to be performed on said target image, and said image processing unit accepts designation of a specific parameter among said plurality of parameters.

4. The image processing apparatus according to claim 1, wherein said image processing unit performs said image processing on said target image by changing an image processing parameter until said second charged amount no longer exceeds said upper limit of charged amount.

5. The image processing apparatus according to claim 1, wherein said image processing refers to processing for changing print density of at least a partial area of said target image.

6. The image processing apparatus according to claim 5, wherein said image processing refers to processing for making print density of a colored area included in said partial area lower than print density of a monochrome area included in said partial area.

7. The image processing apparatus according to claim 1, further comprising a presenting unit for presenting, as a preview image, said image data obtained as a result of said image processing.

8. The image processing apparatus according to claim 1, further comprising an accepting unit for accepting designation of said image processing.

9. The image processing apparatus according to claim 1, wherein said setting unit sets said upper limit of charged amount based on said first charged amount.

10. The image processing apparatus according to claim 1, wherein said image processing performed by said image processing unit is a processing for lowering print density of a partial area of said target image so that print density of a colored area included in said partial area is lowered.

11. The image processing apparatus according to claim 1, wherein said image processing performed by said image processing unit is a processing for lowering print density of a partial area of target image so that print density of a colored area included in said partial area is lowered prior to a monochrome area included in said partial area.

12. A method of processing an image, comprising the steps of:

calculating a first charged amount to be charged when a printed image is printed from the image data in an image processing apparatus;

setting an upper limit of a charged amount for printing of said image data;

determining whether said first charged amount exceeds said upper limit of said charged amount;

analyzing a whole area of a printed image;

selecting a target image, said target image corresponding to a portion of said printed image that is less than an entire region of the printed image; and performing image processing on said selected target image with a priority placed on the target image to create a revised printed image such that the target image is processed to a greater extent than a remainder of the printed image and such that a second charged amount to be charged when said revised printed image is printed no longer exceeds said upper limit of said charged amount, when it is determined in said determining step that said first charged amount exceeds said upper limit of said charged amount.

13. The method of processing an image according to claim 12, wherein a plurality of types of image processing can be performed on said image data, and said step of performing image processing includes the step of accepting selection of specific image processing from said plurality of types of image processing.

14. The method of processing an image according to claim 12, wherein there are a plurality of parameters available for said image processing performed on said image data, and said step of performing image processing includes the step of accepting designation of a specific parameter among said plurality of parameters.

15. The method of processing an image according to claim 12, wherein said step of performing image processing includes the step of performing said image processing on said target image by changing a parameter until said second charged amount no longer exceeds said upper limit of charged amount.

16. The method of processing an image according to claim 12, wherein said image processing refers to processing for changing print density of at least a partial area of said target image.

17. The method of processing an image according to claim 16, wherein said image processing refers to processing for making print density of a colored area included in said partial area lower than print density of a monochrome area included in said partial area.

18. The method of processing an image according to claim 12, further comprising the step of presenting, as a preview image, said image data obtained as a result of said image processing.

19. The method of processing an image according to claim 12, further comprising the step of accepting designation of said image processing.

20. The method of processing an image according to claim 12, wherein said setting step includes the step of setting said upper limit of charged amount based on said first charged amount.

21. The method of processing an image according to claim 12, wherein said image processing is a processing for lowering print density of a partial area of said target image so that print density of a colored area included in said partial area is lowered.

22. The method of processing an image according to claim 12, wherein said image processing is a processing for lowering print density of a partial area of said target image so that print density of a colored area included in said partial area is lowered prior to a monochrome area included in said partial area.

23. A nontransitory computer-readable medium containing a program product causing a computer to perform image processing comprising the steps of:

calculating a first charged amount to be charged when a printed image is printed from the image data in an image processing apparatus;

setting an upper limit of a charged amount for printing of said image data;

determining whether said first charged amount exceeds said upper limit of said charged amount;

analyzing a whole area of a printed image;

selecting a target image, said target image corresponding to a portion of the printed image that is less than an entire region of the printed image; and performing image processing on said selected target image with a priority placed on the target image to create a revised printed image such that the target image is processed to a greater extent than a remainder of the printed image and such that a second charged amount to be charged when said revised printed image is printed no longer exceeds said upper limit of said charged amount, when it is determined in said determining step that said first charged amount exceeds said upper limit of said charged amount.

* * * * *

UNITED STATES PATENT AND TRADEMARK OFFICE

CERTIFICATE OF CORRECTION

PATENT NO. : 7,912,394 B2
APPLICATION NO. : 11/270454
DATED : March 22, 2011
INVENTOR(S) : Atsushi Kondo It is certified that error appears in the above-identified patent and that said Letters Patent is hereby corrected as shown below:

In column 14, following line 21, please insert the following claims:

-- 24. The image processing apparatus according to claim 5, wherein
said image processing refers to processing for making print density of an area other than a character area included in said partial area lower than print density of said character area included in said partial area.

25. The image processing apparatus according to claim 5, wherein
said image processing refers to processing for lowering print density of a background area included in said partial area.

26. The image processing apparatus according to claim 25, wherein
said image processing refers to processing for lowering print density of an area other than a ground pattern in said background area.

27. The image processing apparatus according to claim 1, wherein
said image processing refers to processing for reducing a print area of at least a partial area of said target image.

28. The image processing apparatus according to claim 27, wherein
said image processing refers to processing for size reduction such that a reduction scale of a size of a character area included in said partial area is different from a reduction scale of a size of an area other than said character area included in said partial area.

29. The image processing apparatus according to claim 1, wherein
said image processing refers to processing for changing resolution of at least a partial area of said target image.

Signed and Sealed this
Thirteenth Day of March, 2012

David J. Kappos

David J. Kappos
*Director of the United States Patent and Trademark Office*

30. The image processing apparatus according to claim 29, wherein
said image processing refers to processing for changing resolution of an area other than a character area included in said partial area.

31. The method of processing an image according to claim 16, wherein
said image processing refers to processing for making print density of an area other than a character area included in said partial area lower than print density of said character area included in said partial area.

32. The method of processing an image according to claim 16, wherein
said image processing refers to processing for lowering print density of a background area included in said partial area.

33. The method of processing an image according to claim 32, wherein
said image processing refers to processing for lowering print density of an area other than a ground pattern in said background area.

34. The method of processing an image according to claim 12, wherein
said image processing refers to processing for reducing a print area of at least a partial area of said target image.

35. The method of processing an image according to claim 34, wherein
said image processing refers to processing for size reduction such that a reduction scale of a size of a character area included in said partial area is different from a reduction scale of a size of an area other than said character area included in said partial area.

36. The method of processing an image according to claim 12, wherein
said image processing refers to processing for changing resolution of at least a partial area of said target image.

37. The method of processing an image according to claim 36, wherein
said image processing refers to processing for changing resolution of an area other than a character area included in said partial area. --

UNITED STATES PATENT AND TRADEMARK OFFICE

CERTIFICATE OF CORRECTION

PATENT NO. : 7,912,394 B2
APPLICATION NO. : 11/270454
DATED : March 22, 2011
INVENTOR(S) : Atsushi Kondo It is certified that error appears in the above-identified patent and that said Letters Patent is hereby corrected as shown below:

Delete the title page and substitute therefore the attached title page showing the corrected number of claims in patent.

In column 14, following line 21, please insert the following claims:

-- 24. The image processing apparatus according to claim 5, wherein
said image processing refers to processing for making print density of an area other than a character area included in said partial area lower than print density of said character area included in said partial area.

25. The image processing apparatus according to claim 5, wherein
said image processing refers to processing for lowering print density of a background area included in said partial area.

26. The image processing apparatus according to claim 25, wherein
said image processing refers to processing for lowering print density of an area other than a ground pattern in said background area.

27. The image processing apparatus according to claim 1, wherein
said image processing refers to processing for reducing a print area of at least a partial area of said target image.

28. The image processing apparatus according to claim 27, wherein
said image processing refers to processing for size reduction such that a reduction scale of a size of a character area included in said partial area is different from a reduction scale of a size of an area other than said character area included in said partial area.

This certificate supersedes the Certificate of Correction issued March 13, 2012.

Signed and Sealed this
Third Day of April, 2012

David J. Kappos

David J. Kappos
*Director of the United States Patent and Trademark Office*

29. The image processing apparatus according to claim 1, wherein
said image processing refers to processing for changing resolution of at least a partial area of said target image.

30. The image processing apparatus according to claim 29, wherein
said image processing refers to processing for changing resolution of an area other than a character area included in said partial area.

31. The method of processing an image according to claim 16, wherein
said image processing refers to processing for making print density of an area other than a character area included in said partial area lower than print density of said character area included in said partial area.

32. The method of processing an image according to claim 16, wherein
said image processing refers to processing for lowering print density of a background area included in said partial area.

33. The method of processing an image according to claim 32, wherein
said image processing refers to processing for lowering print density of an area other than a ground pattern in said background area.

34. The method of processing an image according to claim 12, wherein
said image processing refers to processing for reducing a print area of at least a partial area of said target image.

35. The method of processing an image according to claim 34, wherein
said image processing refers to processing for size reduction such that a reduction scale of a size of a character area included in said partial area is different from a reduction scale of a size of an area other than said character area included in said partial area.

36. The method of processing an image according to claim 12, wherein
said image processing refers to processing for changing resolution of at least a partial area of said target image.

37. The method of processing an image according to claim 36, wherein
said image processing refers to processing for changing resolution of an area other than a character area included in said partial area. --

(12) United States Patent
Kondo

(10) Patent No.: US 7,912,394 B2
(45) Date of Patent: Mar. 22, 2011

(54) IMAGE PROCESSING APPARATUS CAPABLE OF CARRYING OUT IMAGE PROCESSING SUCH THAT CHARGED AMOUNT DOES NOT EXCEED UPPER LIMIT

(75) Inventor: Atsushi Kondo, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 626 days.

(21) Appl. No.: 11/270,454

(22) Filed: Nov. 10, 2005

(65) Prior Publication Data

US 2007/0031160 A1 Feb. 8, 2007

(30) Foreign Application Priority Data

Aug. 3, 2005 (JP) ..... 2005-225611

(51) Int. Cl.
*G03G 21/02* (2006.01)

(52) U.S. Cl. ..... 399/79

(58) Field of Classification Search ..... 399/79
See application file for complete search history.

(56) References Cited

U.S. PATENT DOCUMENTS

2005/0024670 A1* 2/2005 Aoki ..... 358/1.13

FOREIGN PATENT DOCUMENTS

| | | |
|---|---|---|
| JP | 9-138621 | 5/1997 |
| JP | 2000-019906 | 1/2000 |
| JP | 2001-022671 | 1/2001 |
| JP | 2001-063189 (A) | 3/2001 |
| JP | 2001-083845 A | 3/2001 |
| JP | 2003-114596 | 4/2003 |
| JP | 2003-125211 A | 4/2003 |
| JP | 2004-157190 A | 6/2004 |
| JP | 2005-047210 | 2/2005 |
| JP | 2005-062755 | 3/2005 |
| JP | 2005-174172 | 6/2005 |

OTHER PUBLICATIONS

Japanese Office Action (with English language translation) dated Aug. 7, 2007.
Decision to Grant Patent issued Mar. 12, 2008 in Japanese Patent Application No. 2005-225611 and English translation thereof.

* cited by examiner

*Primary Examiner* -- David M Gray
*Assistant Examiner* -- Erika Villaluna
(74) *Attorney, Agent, or Firm* - Buchanan Ingersoll & Rooney PC

(57) ABSTRACT

In a printing apparatus, a charged amount to be charged when printing is carried out under a predetermined condition is calculated in advance. If the charged amount is lower than an upper limit of the charged amount set by a user, printing is performed. Meanwhile, if the charged amount exceeds the upper limit, image processing for suppressing the charged amount or processing for changing a parameter is performed. Then, when the charged amount becomes lower than the upper limit, printing is performed.

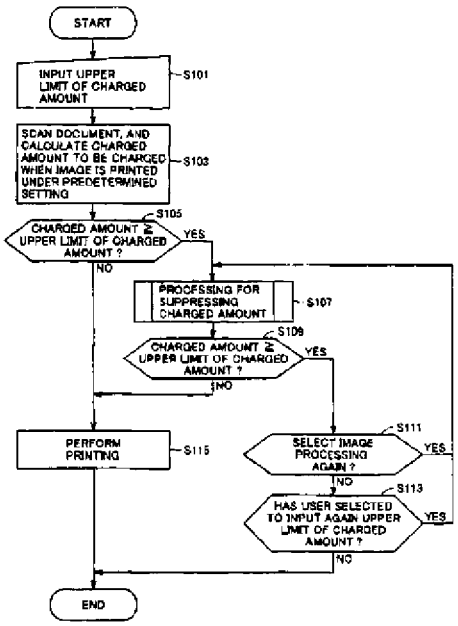

37 Claims, 12 Drawing Sheets